US012111134B2

(12) United States Patent
Moretti

(10) Patent No.: US 12,111,134 B2
(45) Date of Patent: Oct. 8, 2024

(54) RECOIL DAMPING DEVICE FOR PORTABLE FIREARMS

(71) Applicant: BENELLI ARMI S.P.A., Urbino (IT)

(72) Inventor: Luigi Moretti, Collebeato (IT)

(73) Assignee: BENELLI ARMI S.P.A., Urbino PU (IT)

( * ) Notice: Subject to any disclaimer, the term of this patent is extended or adjusted under 35 U.S.C. 154(b) by 0 days.

(21) Appl. No.: 18/170,682

(22) Filed: Feb. 17, 2023

(65) Prior Publication Data

US 2023/0266097 A1 Aug. 24, 2023

(30) Foreign Application Priority Data

Feb. 21, 2022 (IT) ..... 102022000003200

(51) Int. Cl.
*F41C 23/06* (2006.01)
*F41C 23/18* (2006.01)

(52) U.S. Cl.
CPC ..... *F41C 23/06* (2013.01); *F41C 23/18* (2013.01)

(58) Field of Classification Search
CPC ..... F41C 23/06; F41C 23/08
See application file for complete search history.

(56) References Cited

U.S. PATENT DOCUMENTS 524,458 A * 8/1894 Blake ..... F41C 23/08 42/74
935,822 A * 10/1909 Schmidt ..... F41C 23/06 42/74
1,042,132 A * 10/1912 Long ..... F41C 23/08 42/74
1,255,566 A * 2/1918 Pearson ..... F41C 23/06 42/74
1,412,017 A * 4/1922 Johnson ..... F41C 23/06 42/105
2,344,752 A * 3/1944 Utz ..... F41C 23/08 42/74
2,754,608 A * 7/1956 Stieffel, Jr. ..... F41C 23/06 42/74
3,001,312 A * 9/1961 Campbell ..... F41C 23/06 42/74
3,039,222 A * 6/1962 Hoge ..... F41C 23/06 42/74
3,176,424 A * 4/1965 Hoge ..... F41C 23/06 42/74
3,233,354 A * 2/1966 Ahearn ..... F41C 23/06 42/74

(Continued)

FOREIGN PATENT DOCUMENTS

EP 0557209 8/1993
FR 1021485 2/1953

(Continued)

*Primary Examiner* — Derrick R Morgan
(74) *Attorney, Agent, or Firm* — DUANE MORRIS LLP; Gregory M. Lefkowitz

(57) ABSTRACT

A recoil damping device for portable firearms, including a damping means inserted in the casing; a movable insert is functionally associated with the damping means and slide along a direction that is substantially axial with respect to the casing; the damping means is constituted by a body formed by a cellular solid having a stochastic structure, such as a foam, or having a nonstochastic structure, such as a reticular structure, lattice, etc.

15 Claims, 17 Drawing Sheets

(56) References Cited

U.S. PATENT DOCUMENTS

| | | | | |
|---|---|---|---|---|
| 3,371,442 | A * | 3/1968 | Carlson | F41C 23/06 42/74 |
| 3,491,473 | A * | 1/1970 | Eastin | F41C 23/06 42/74 |
| 3,696,544 | A * | 10/1972 | Webb | F41C 23/08 42/74 |
| 4,663,877 | A * | 5/1987 | Bragg | F41C 23/06 42/74 |
| 4,683,671 | A * | 8/1987 | Farrar | F41C 23/08 42/74 |
| 5,375,360 | A * | 12/1994 | Vatterott | F41C 23/08 42/74 |
| 7,121,032 | B2 * | 10/2006 | Daul | F41C 23/08 42/1.06 |
| 7,386,952 | B1 * | 6/2008 | Henretty | F41C 23/20 42/74 |
| 7,926,216 | B2 * | 4/2011 | Bentley | F41C 23/06 42/1.06 |
| 8,815,138 | B2 * | 8/2014 | Howe | B29C 33/308 264/278 |
| 9,228,787 | B2 | 1/2016 | Wood et al. | |
| 10,156,422 | B1 * | 12/2018 | Valin | F41C 23/20 |
| 10,228,213 | B1 | 3/2019 | Smith | |
| 2003/0154640 | A1 * | 8/2003 | Bragg | F41C 23/08 42/74 |
| 2006/0096148 | A1 * | 5/2006 | Beretta | F41C 23/06 42/74 |
| 2012/0125699 | A1 | 5/2012 | Guthrie | |
| 2014/0075801 | A1 * | 3/2014 | Moretti | F41C 23/18 42/1.06 |
| 2014/0109452 | A1 | 4/2014 | Baker | |
| 2016/0010944 | A1 * | 1/2016 | Downey | F41C 23/14 42/74 |
| 2016/0273873 | A1 * | 9/2016 | Spyche, Jr. | F16F 9/18 |
| 2018/0017353 | A1 * | 1/2018 | Lesenfants | F41C 23/08 |
| 2019/0316873 | A1 * | 10/2019 | Kronengold | F41C 23/14 |
| 2020/0340778 | A1 * | 10/2020 | Bryan | F41C 23/08 |
| 2021/0247162 | A1 * | 8/2021 | Conway | F41C 23/08 |

FOREIGN PATENT DOCUMENTS

| | | |
|---|---|---|
| RU | 108587 | 9/2011 |
| RU | 190794 | 7/2019 |

* cited by examiner

RECOIL DAMPING DEVICE FOR PORTABLE FIREARMS

The present invention relates to a recoil damping device for portable firearms.

As is known, the purpose of the stock of a rifle or shotgun is to set the distance between the shooter's shoulder and the trigger, to be part of the definition of the center of gravity of the firearm, and to distribute the pressure produced by the recoil force over a larger surface, so as to reduce its unit value and transmit it to the shooter's shoulder.

Numerous systems have been proposed aimed at reducing the dynamic load on the shoulder caused by the recoil of the firearm, or at improving its ballistic characteristics.

The prior art systems include accessories to be applied to the stock and internal mechanisms of various kinds.

For example, known damping systems have an elastic portion formed in the rear part of the stock and adapted to partially absorb recoil energy by deforming.

A major drawback of such type of system is that the deformation of elastic portion during the recoil step, easily causes lateral oscillations of backward motion of the rifle. Therefore, the movement of the firearm during recoil does not follow the longitudinal axis of the firearm but deviates, resulting in loss of line of sight and of correct shouldering by the shooter.

Another known damping system is substantially constituted by a buttstock mounted on the stock of the rifle by the interposition of a damping means generally constituted by helical springs.

EP2711660B1 discloses a recoil damping device for portable firearms, including a casing in which a recoil damping means is inserted; the damping means includes a fixed part, which is integral with the casing, and a movable part able to slide along a substantially axial direction inside the casing; the damping means is made of a material having a certain elastic hysteresis and includes a set of flexible members connecting the fixed part to the movable part; the flexible members have different stiffness.

US20200340778A1 discloses a buttstock having a compressible body including an anisotropic matrix of flexible material.

U.S. Ser. No. 10/228,213B1 discloses a recoil reduction system including a butt pad assembly with an open-cell lattice structure having a hardness that is substantially greater than that of conventional butt pads.

The system discloses by EP2711660B1, cited above, brilliantly solved various problems of the prior art and was particular able to offer optimal performance for a wide range of ammunition, unlike prior conventional damping systems, by virtue of a differentiated flexibility, i.e., a reduced resistance to small compression which however increases exponentially as the deformation increases.

The aim of the present invention is to provide a recoil damping device for portable firearms that improves over the cited prior art.

Within the scope of this aim, an object of the invention is to provide a damping device equipped with a movable insert having a significantly greater stroke than previously known systems.

A further object of the invention is to provide a device that has a reduced weight with respect to systems of a similar type, an extremely important aspect when the device is used in inertia-driven automatic rifles.

A further object of the invention is to provide a device capable of improving recoil absorption.

A further object of the present invention is to provide a device that allows to optimize the stability of the firearm, avoiding localized deformations that could become fulcrums of rotation of the firearm during firing.

A further object of the invention is to provide a device that is capable of minimizing the recoil force peak while maximizing its time delay.

A further object of the present invention is to provide a device with a reduced number of components to be assembled.

This aim, these objects and others which will become better apparent hereinafter are achieved by a recoil damping device for portable firearms as claimed in the appended claims.

Further characteristics and advantages will become better apparent from the description of preferred but not exclusive embodiments of the invention, illustrated by way of non-limiting example in the accompanying drawings, wherein.

Figure 1:
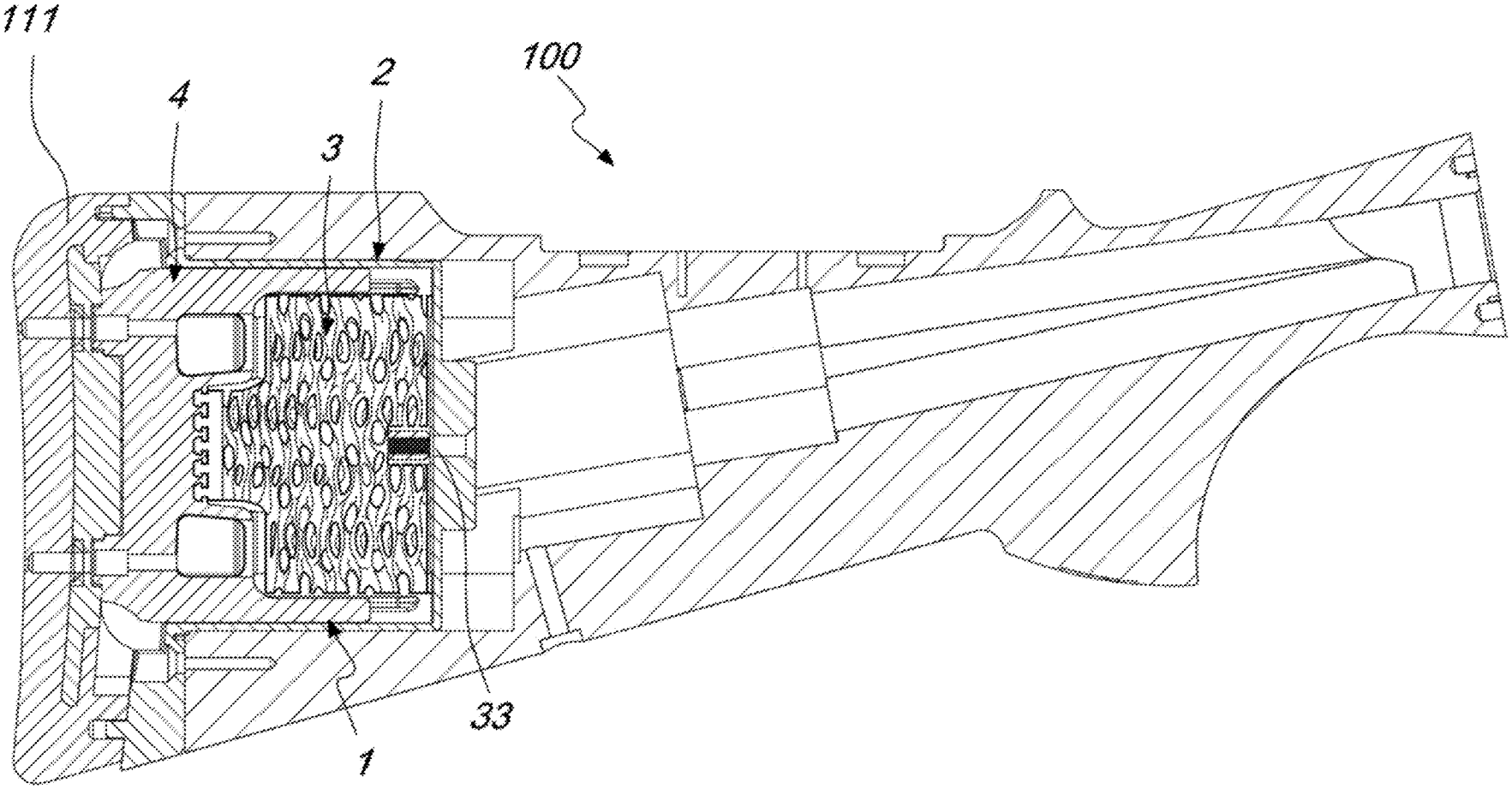
FIG. 1 is a cutout perspective view of the stock of a firearm provided with a recoil damping device, according to the present invention.

With reference to the cited figures, the device according to the invention, generally designated by the reference numeral 1, is arranged in a stock 100 of a firearm, for example a rifle or shotgun.

The device 1 includes a casing 2, having a substantially oval cross-section and wherein a damping means 3 is inserted.

The casing 2 is an independent member, as in the examples shown, or alternatively is constituted by a seat formed in the stock of the firearm.

The device 1 also includes a movable insert 4 functionally associated with the damping means 3 and with which a buttstock 111 can be associated.

The damping means 3 is substantially integral with the casing 2, while the movable insert 4 is adapted to slide along a direction that is substantially axial with respect to the casing 2.

According to an embodiment of the invention, the damping means 3 is rendered integral with the casing 2 by a threaded bushing 33 inserted in the damping means 3 itself.

According to a further embodiment, the damping means 3 is rendered integral with the casing 2 by means of a clip or other system having a similar function.

According to the present invention, the damping means is constituted by a body formed by a cellular solid having a stochastic structure, such as a foam, or a nonstochastic structure, for example a reticular structure, a lattice.

Cellular structures can be provided in various materials, chosen for example from TPU, PA, additive manufacturing materials, etc., and combined with each other in series and/or in parallel.

The body 3 can be provided in various kinds of shapes, depending on the required damping characteristic.

The damping structure can have a continuously variable stiffness, taking advantage of density variations and local variations in the thickness of the structures.

Figure 7:
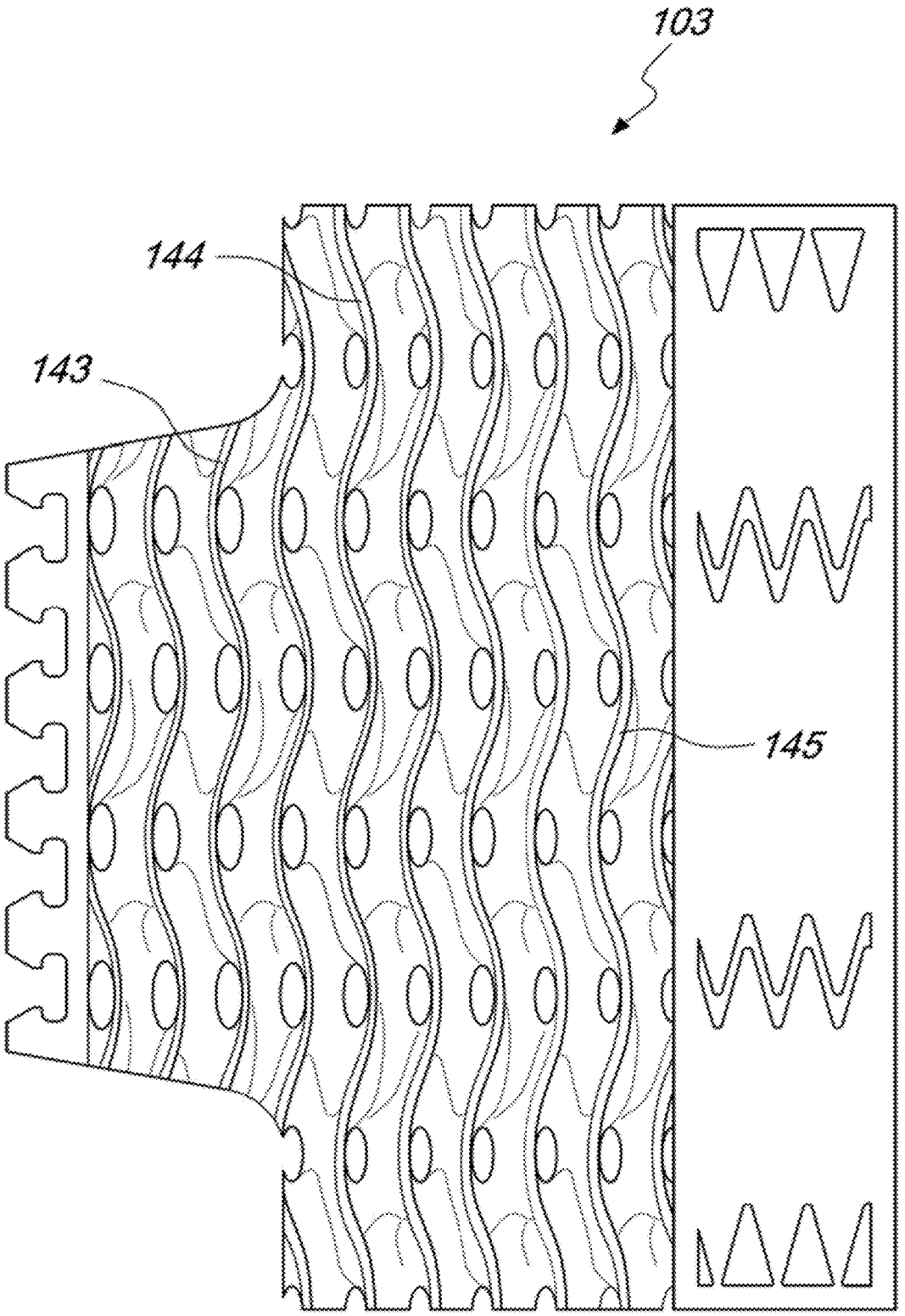
FIGS. 7-9 are perspective views of three embodiments of a damping means.

In the embodiment shown in FIG. 7, three groups of fins, respectively thin fins 143, intermediate fins 144, and thick fins 145, are visible.

In fact, during deformation, the structure interacts, i.e., generates friction, with itself and increases the damping response.

The damping means 3 has a side 31, opposite with respect to the buttstock 111, wherein a denser layer of material has the function of reducing the impact between the casing 2 and the movable insert 4, when the movable insert 4 reaches the end of its stroke.

The movable insert 4 holds the buttstock 111 in position and slides inside the casing 2. The movable insert 4 has a quick coupling system for the damping structure 3. Advantageously, the assembling motion has a direction which is transverse to the sliding direction of the movable insert 4.

Figure 2:
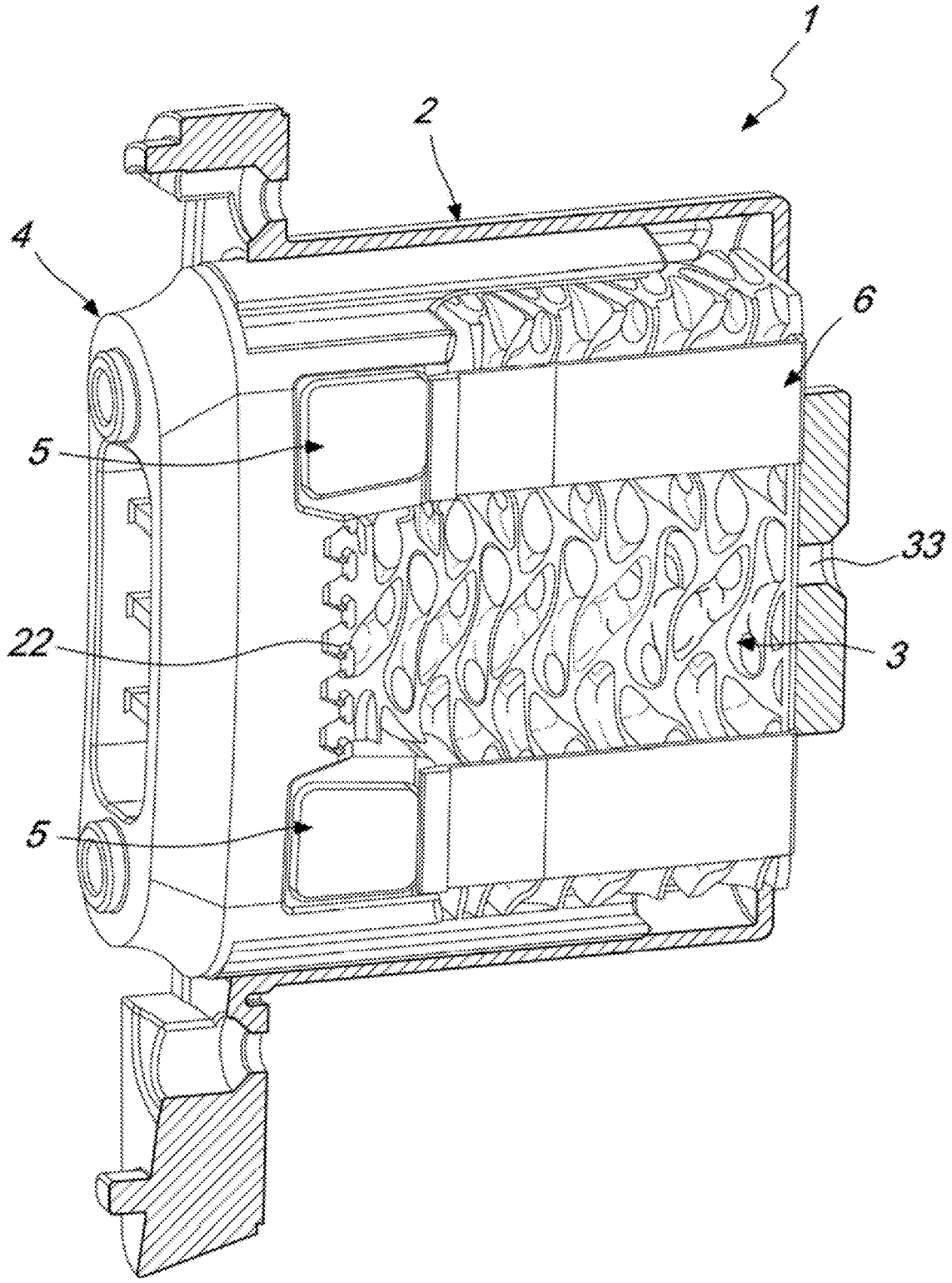
FIG. 2 is a cutout perspective view of the recoil damping device, according to the present invention.
Figure 3:
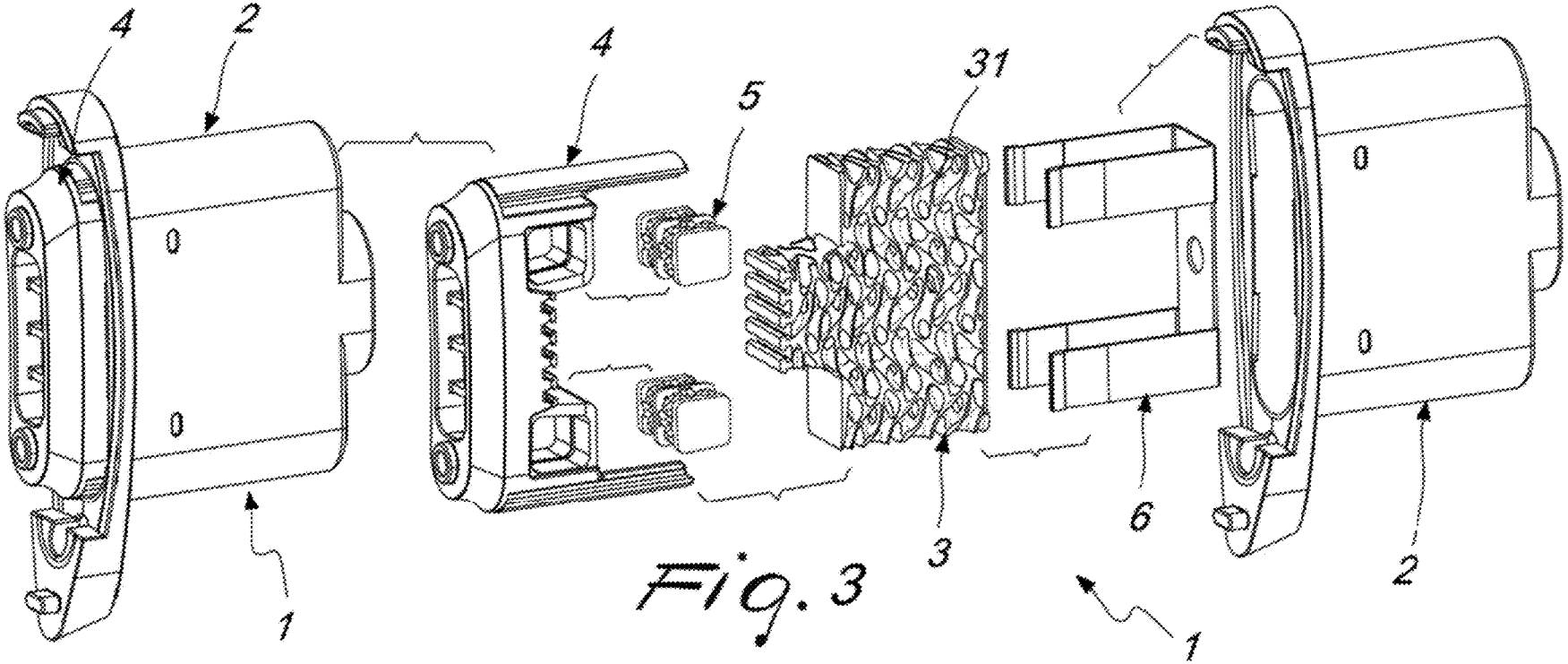
FIG. 3 is an exploded perspective view of the device according to the invention.
Figure 4:
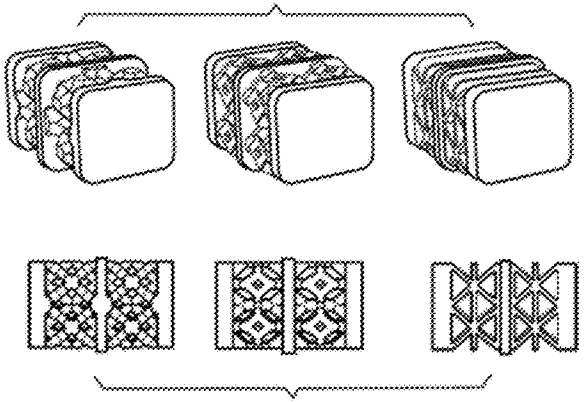
FIG. 4 shows perspective views of embodiments of the primary braking device.
Figure 5:
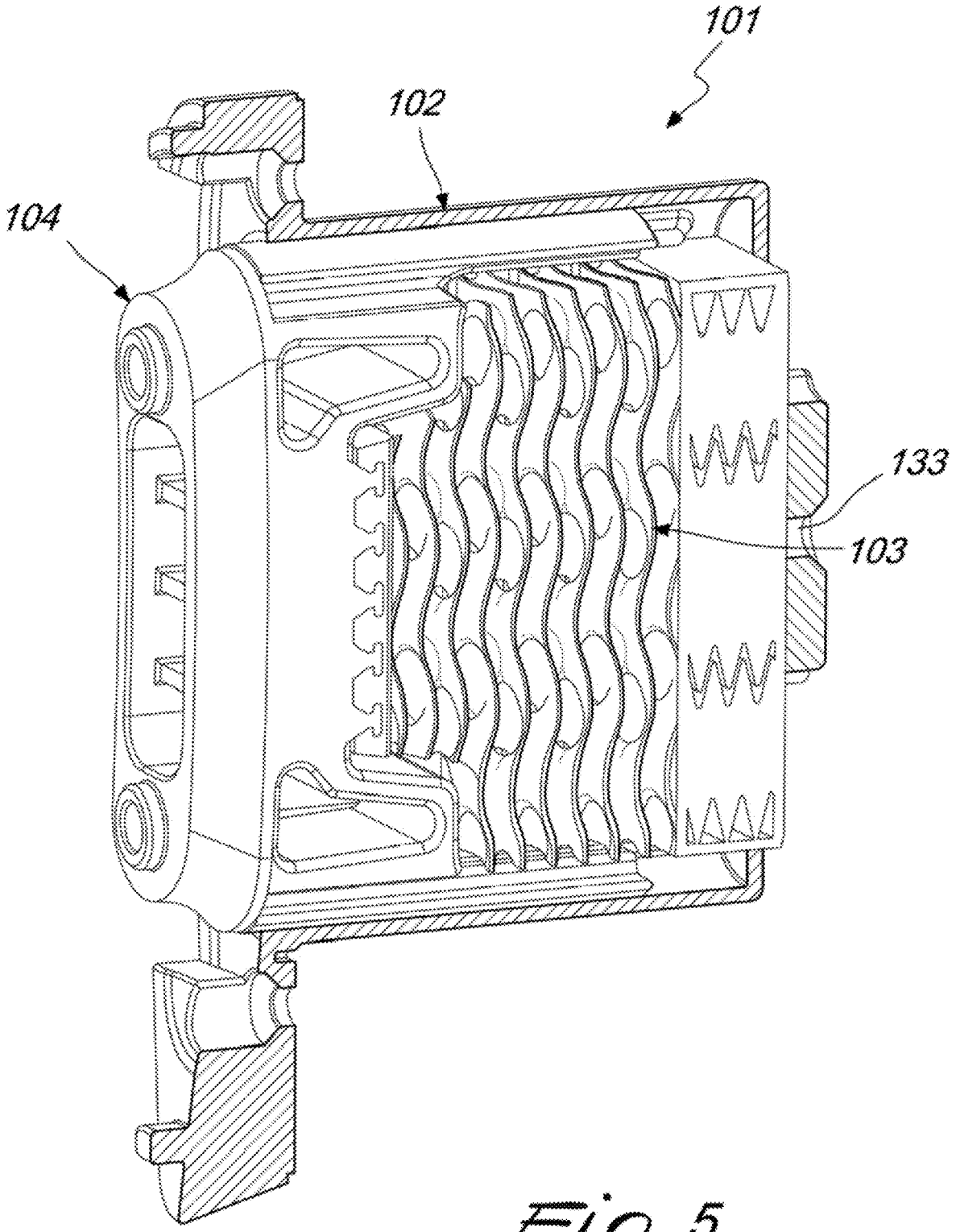
FIG. 5 is a cutout perspective view of the damping device according to a further aspect of the invention.
Figure 6:
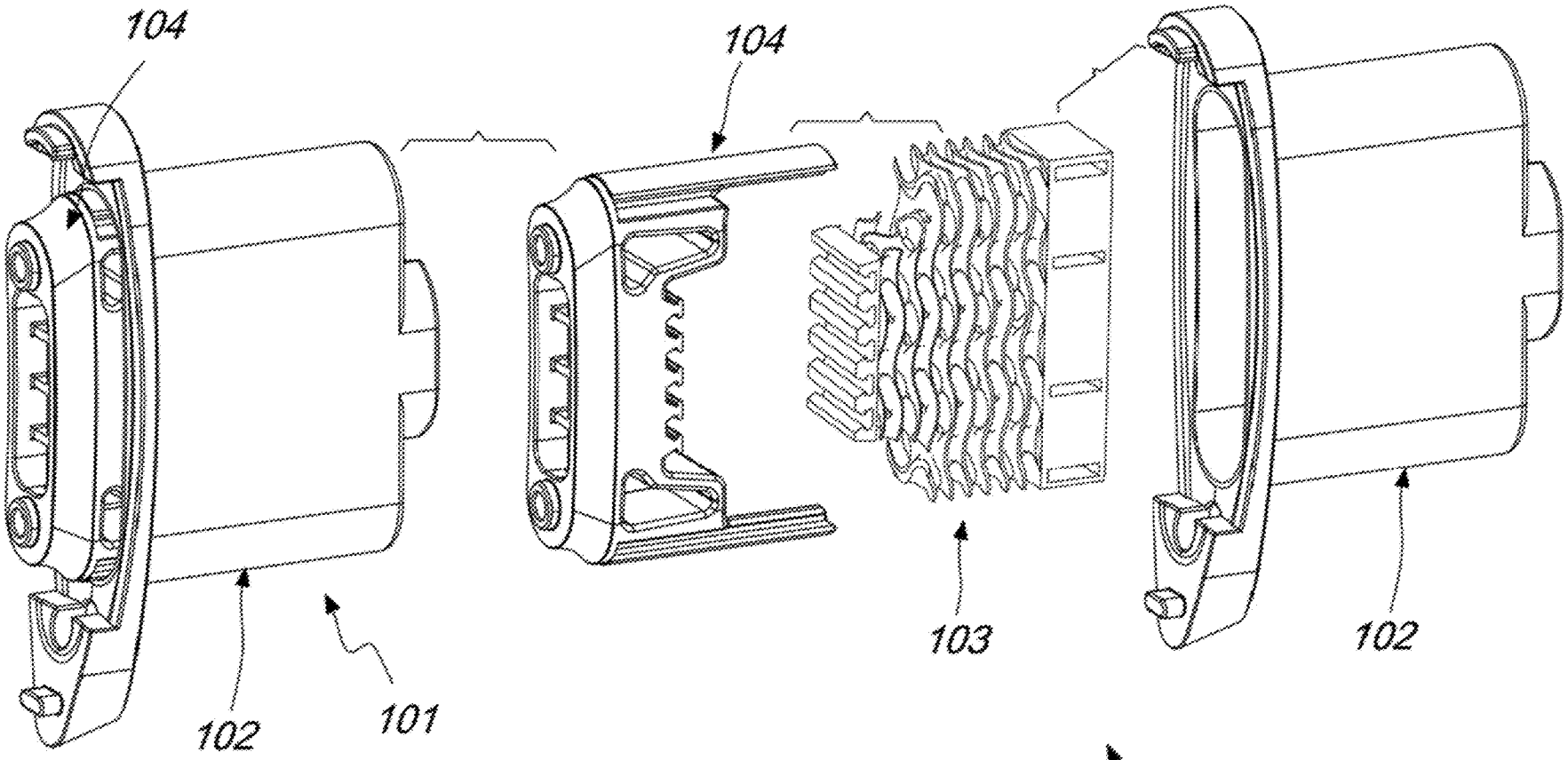
FIG. 6 is an exploded perspective view of the device of the preceding figure.
Figure 10:
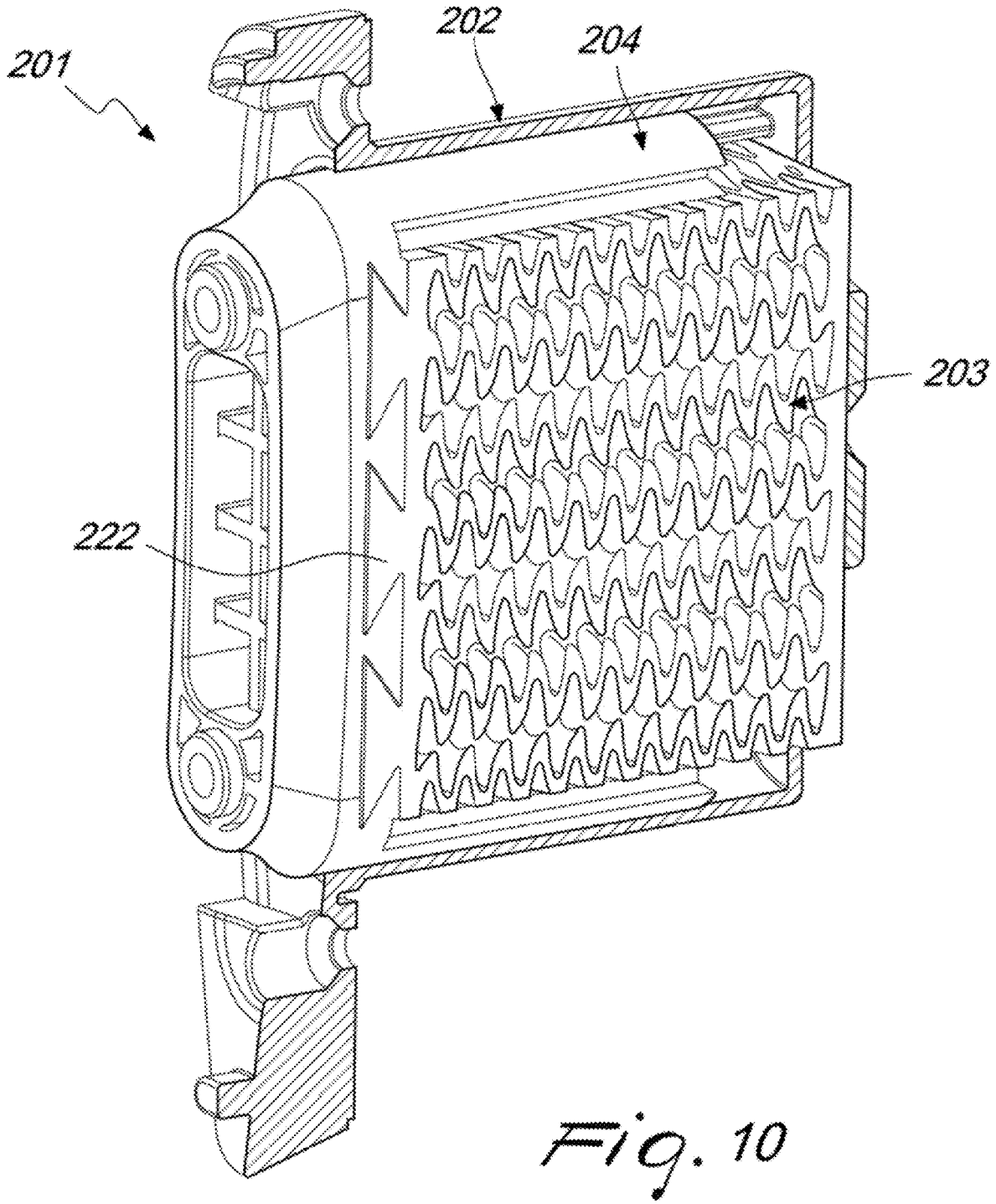
FIG. 10 is a cutout perspective view of the damping device, according to a further aspect of the invention.

The quick coupling system can be of various types; for example, FIG. 2 shows a quick coupling, designated by the reference numeral 22, while FIG. 10 shows another quick coupling, designated by the reference numeral 222.

According to a further aspect of the invention, the device 1 includes a primary brake assembly 5, mounted in the movable insert 4; the primary brake assembly 5 dissipates energy by sliding, with friction, relative to a secondary braking body 6.

The primary braking assembly 5 is formed by various kinds of materials and shapes so that the level of resistance can be adjusted.

The secondary braking body 6 is fixed and interlocked between the support constituted by the casing 2 and the damping means 3; the secondary braking body 6 dissipates energy by sliding, with friction, with respect to the primary braking assembly 5.

The secondary braking body 6 is formed by various kinds of materials and shapes so that the level of resistance can be adjusted.

FIGS. 5 to 9 show a device, generally designated by the reference numeral 101, according to a further aspect of the invention, which includes a casing 102, having a substantially oval cross-section, in which a damping means 103 is inserted.

The casing 102 can be an independent member, as in the examples shown, or can be constituted by a seat formed in the stock of the firearm.

The device 101 also includes a movable insert 104 functionally associated with the damping means 103.

The damping means 103 is substantially integral with the casing 102, while the movable insert 104 is adapted to slide along a direction that is substantially axial with respect to the casing 102.

According to the embodiment shown herein, the damping means 103 is rendered integral with the casing 102 by a threaded bushing 33 inserted in the damping means 103 itself.

According to a further embodiment, the damping means 103 is rendered integral with the casing 102 by a clip or other system having a similar function.

According to the present invention, the damping means is constituted by a body formed by a cellular solid having a stochastic structure, such as a foam, or a nonstochastic structure, for example a reticular structure, a lattice.

Cellular structures can be made of various materials, chosen for example from TPU, PA, additive manufacturing materials, etc., and combined with each other in series and/or in parallel.

The body 103 is formed in shapes of various kinds, depending on the required damping characteristic.

The damping structure may have a continuously variable stiffness, by taking advantage of density variations and local variations in structure thickness, as described for example above with reference to the embodiment shown in FIG. 7.

During deformation, the structure interacts, i.e., generates friction, with itself and increases the damping response.

Figure 8:
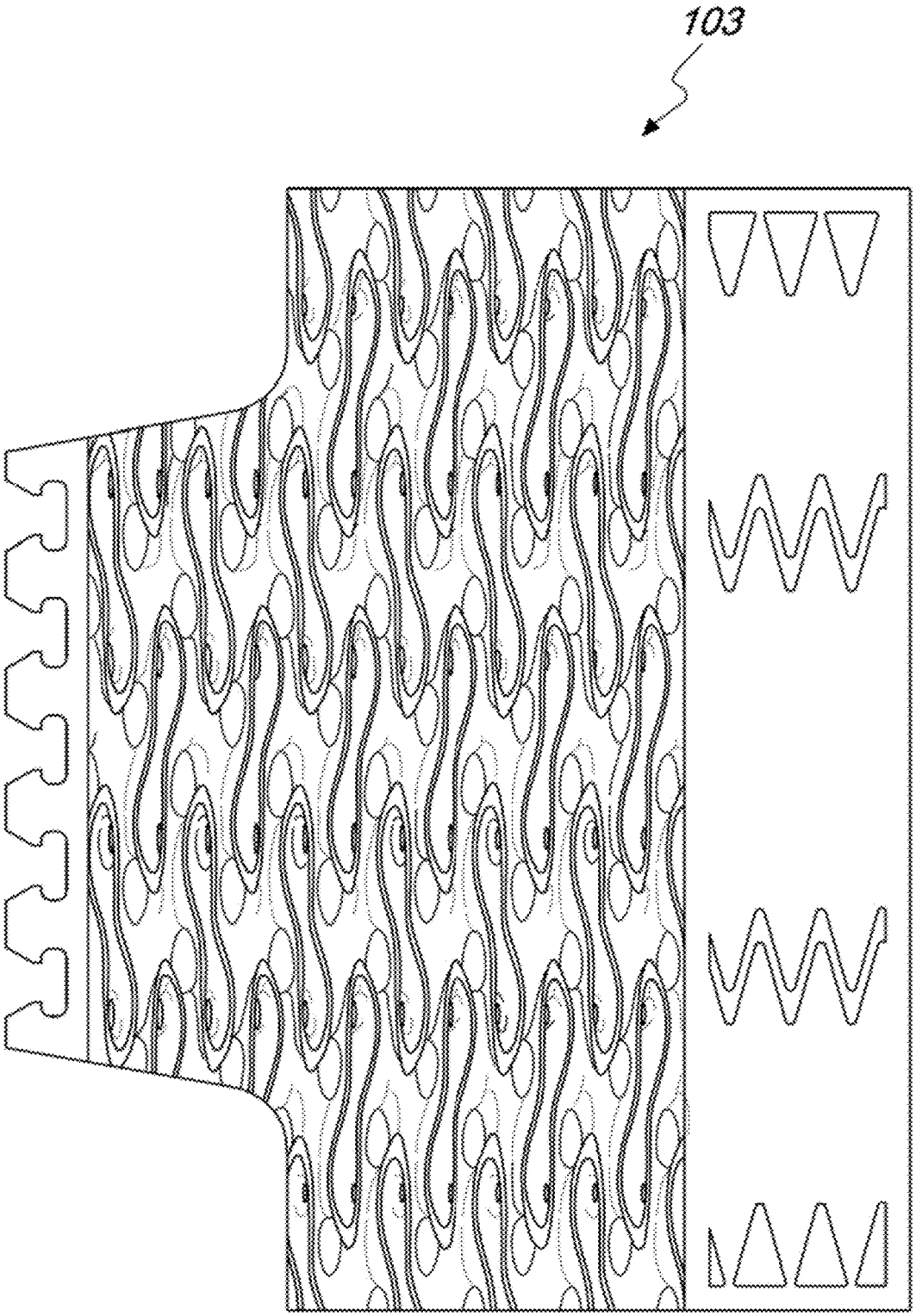
Figure 9:
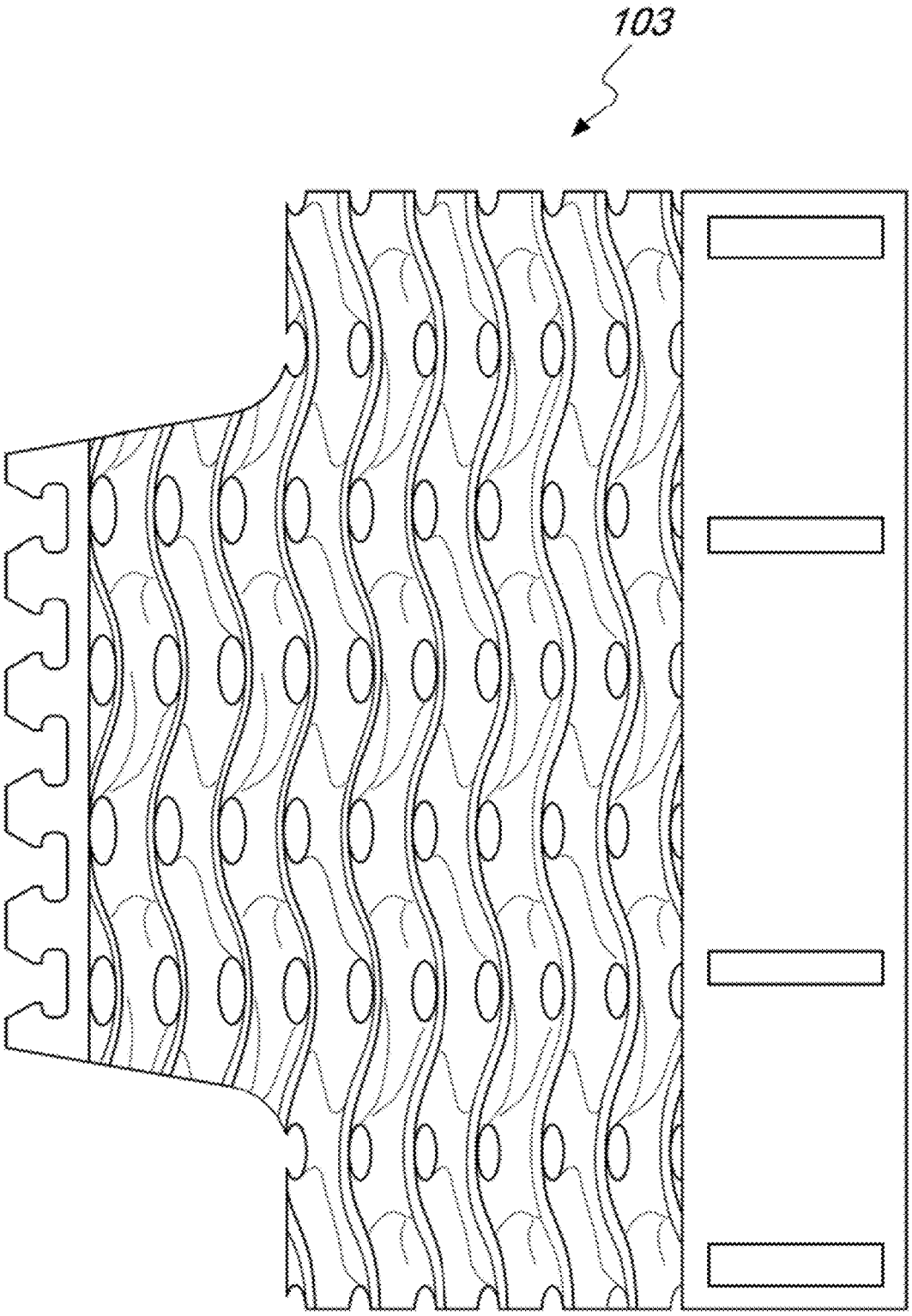

FIGS. 7-9 show some embodiments of the damping structure 103 with variable shape, density and material.

Figure 11:
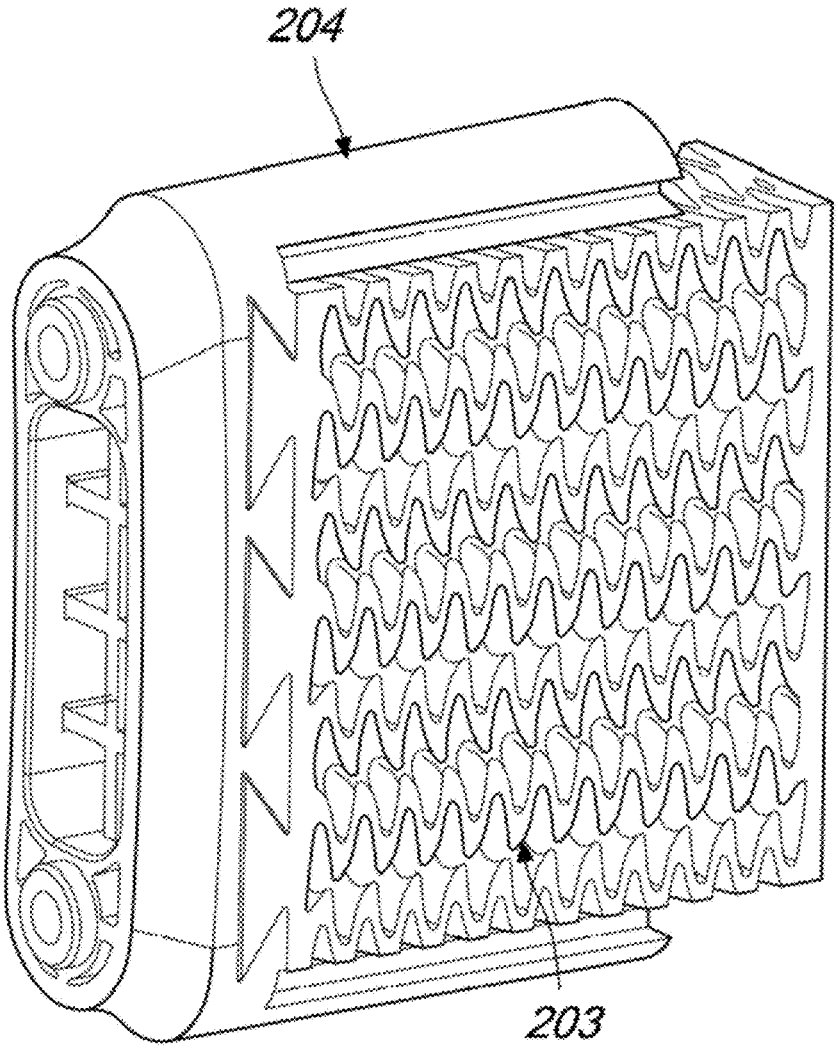
FIG. 11 is a perspective view of the movable insert functionally associated with the damping means of the device of the preceding figure.
Figure 12:
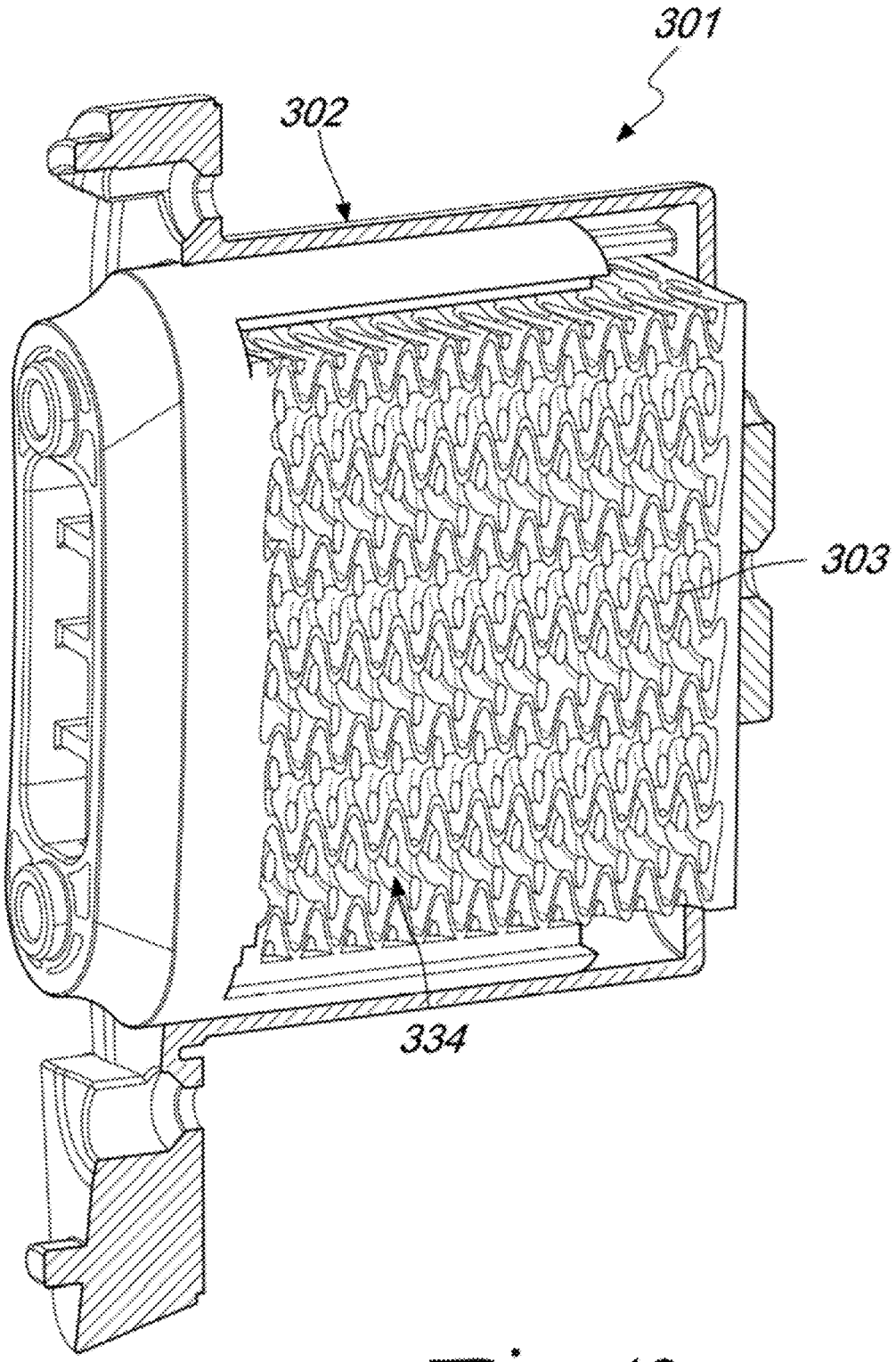
FIG. 12 is a cutout perspective view of the damping device, according to a further aspect of the invention.

FIGS. 10-11 show a device, generally designated by the reference numeral 201, according to a further aspect of the invention, including a casing 202, having a substantially oval cross-section, in which a damping means 203 is inserted.

The device 201 also includes a movable insert 204 functionally associated with the damping means 203.

The damping means 203 is substantially integral with the casing 202, while the movable insert 204 is adapted to slide along a direction that is substantially axial with respect to the casing 202.

As described in relation to the previous embodiments, the damping means 203 is rendered integral with the casing 202 by a locking system which includes a threaded bushing, not visible in FIGS. 10 and 11, or by a clip system or other similar system.

According to this embodiment of the invention, the damping means 203 is larger in size with respect to the embodiments described above and is constituted by a body formed by a cellular solid having a stochastic structure, such as a foam, or a nonstochastic structure, for example a reticular structure, a lattice.

The cellular structures are formed by using various materials, chosen for example among TPU, PA, additive manufacturing materials, etc., and combined with each other in series and/or in parallel.

FIGS. 12-15 show a device, generally designated by the reference numeral 301, according to a further aspect of the invention, including a casing 302, having a substantially oval cross-section, in which a damping means 303 is inserted.

The casing 302 can be an independent member, as in the embodiments shown, or can be constituted by a seat formed in the stock of the firearm.

The device 301 also includes a movable insert formed monolithically with the damping means 303, forming a monolithic body 334.

According to this embodiment, the device 301 does not have a braking device and is provided with an increased damping structure which is monolithic with the movable insert.

According to this embodiment, the damping structure is formed by two distinct and concatenated geometries working in parallel.

Figure 13:
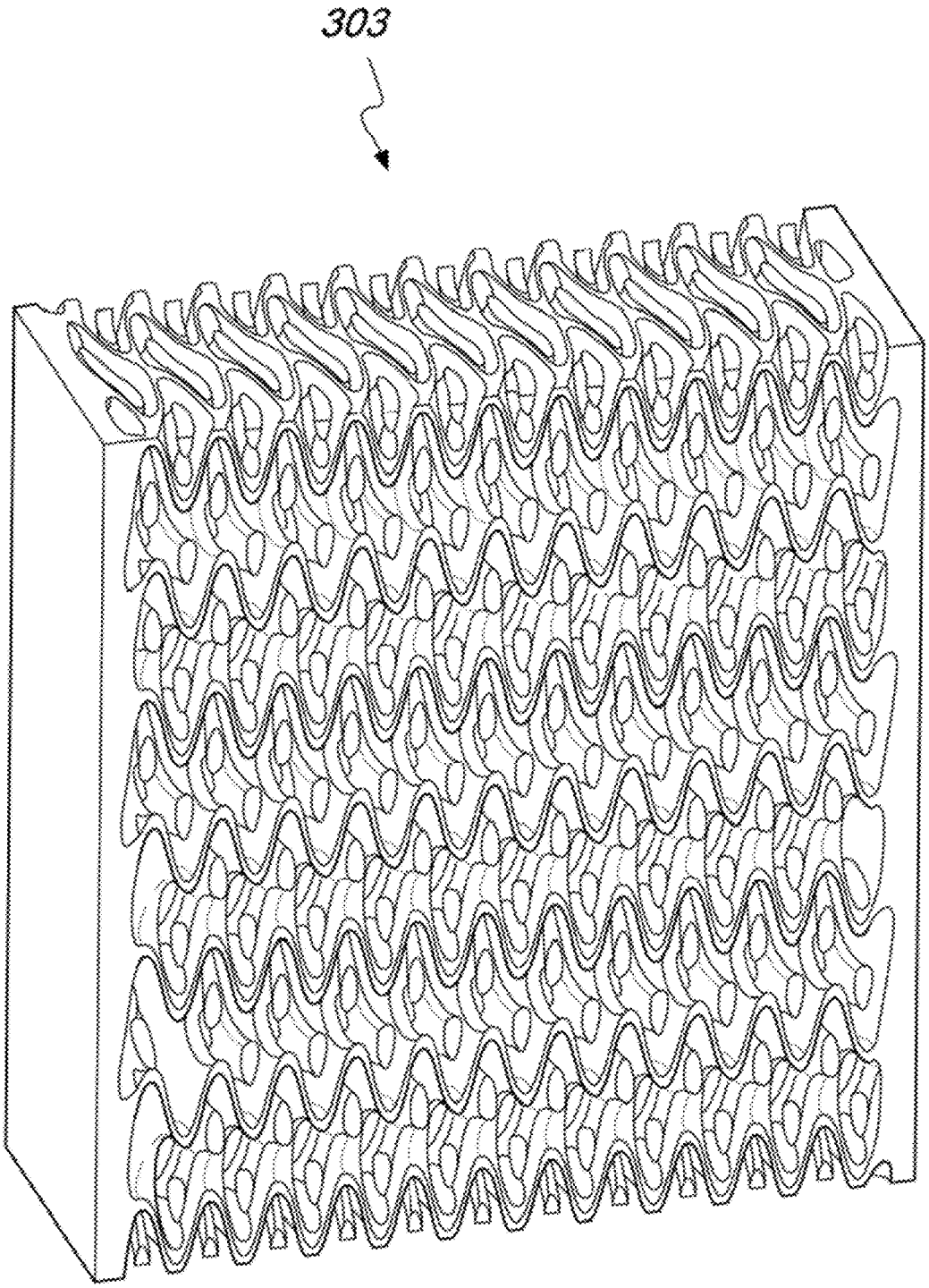
FIGS. 13-15 are perspective views of the concatenated internal structures of the damping means.
Figure 14:
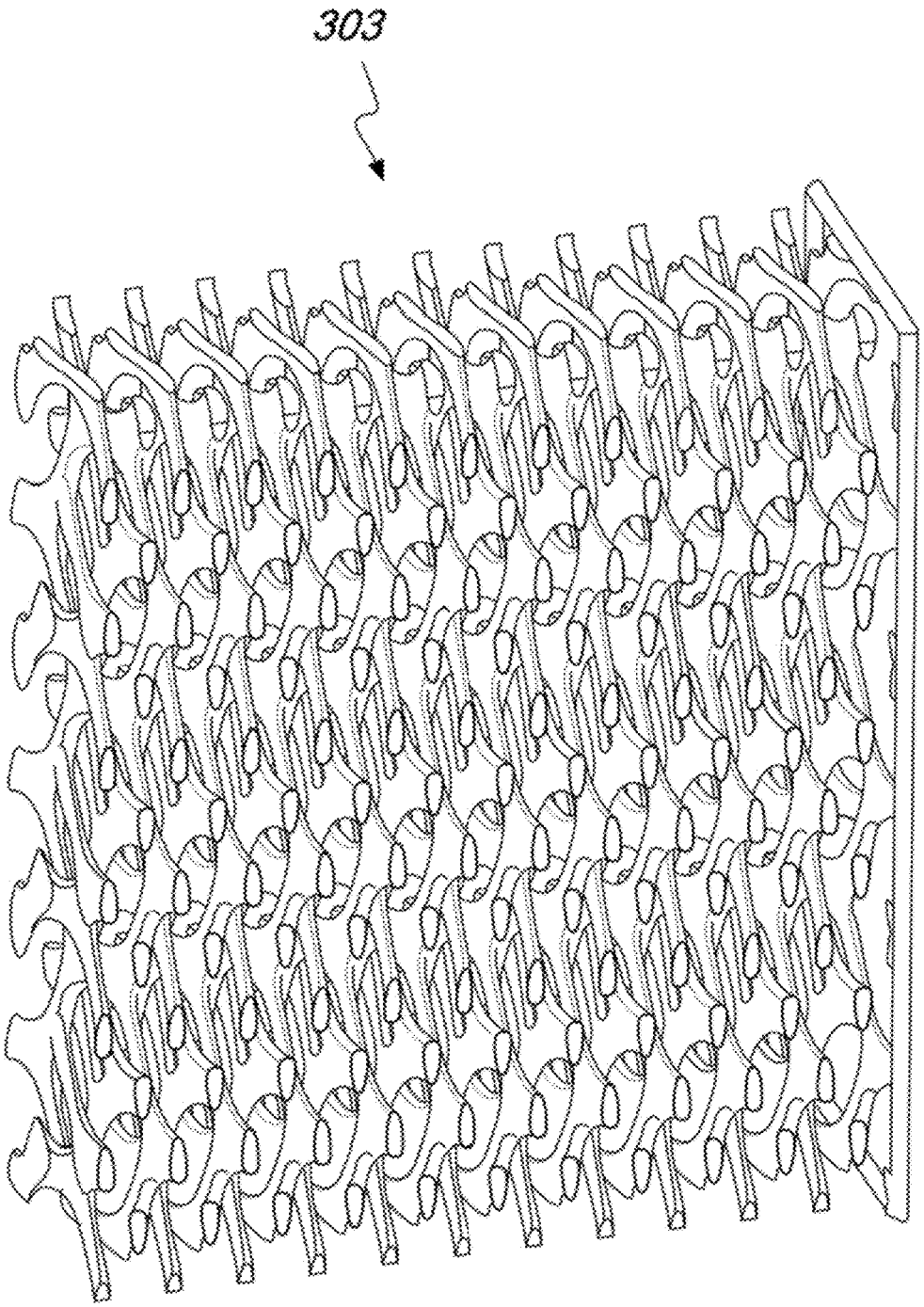
Figure 15:
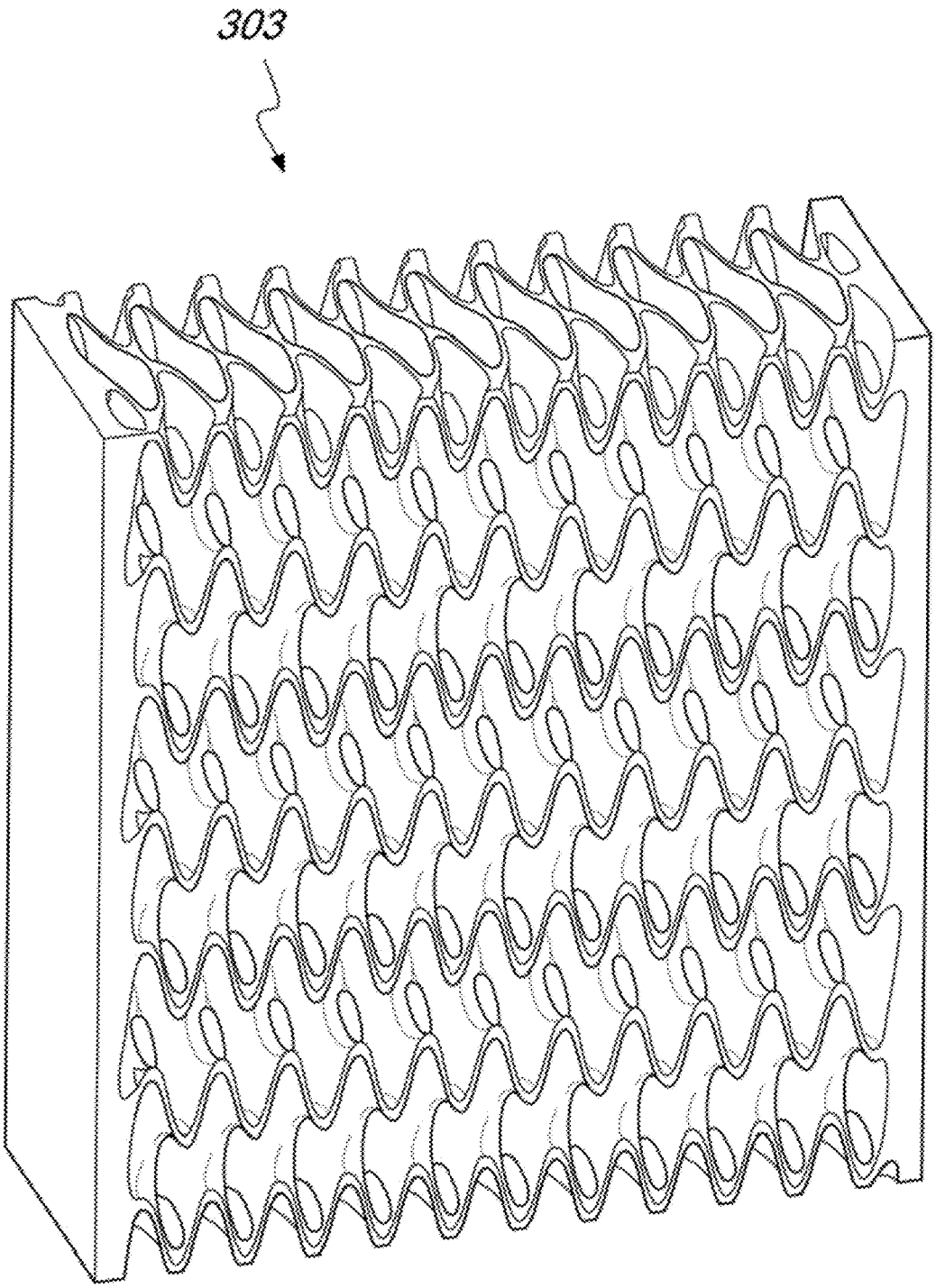

FIGS. 13-15 show the concatenated internal structures of the damping means 303.

Figure 16:
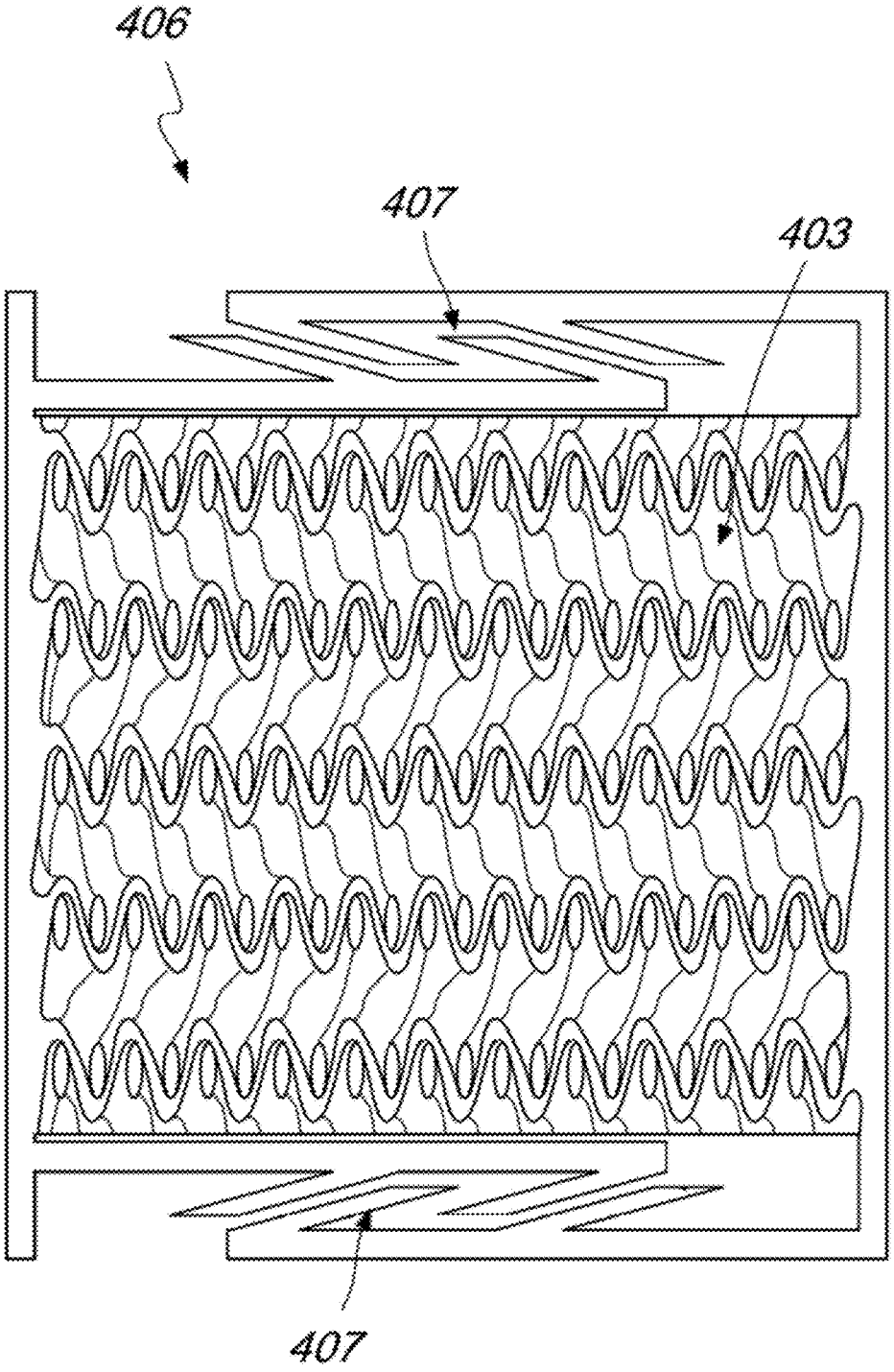
FIG. 16 is a side view of a braking body, according to a further aspect of the invention, formed by modeling the internal insert.

FIG. 16 shows a device, according to a further aspect of the invention, which includes a braking body, generally designated by the reference numeral 406, formed by appropriately modeling the geometries of an internal insert 403, without using any additional components.

According to this embodiment, the integrated monolithic body has two pairs of laminas 407 that create friction during translation of the movable insert.

Figure 17:
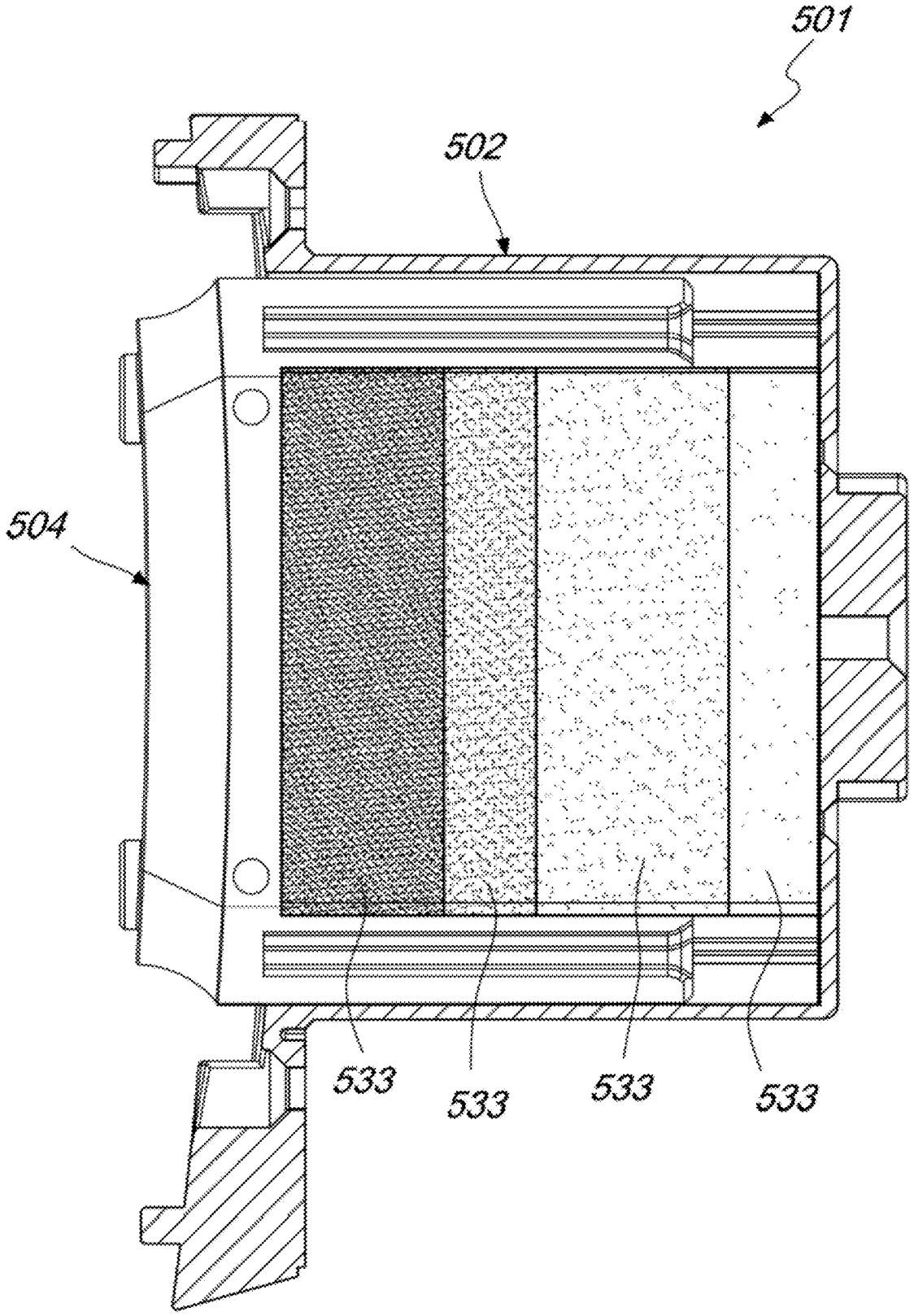
FIG. 17 is a sectional view of the damping device, according to a further aspect of the invention.
Figure 18:
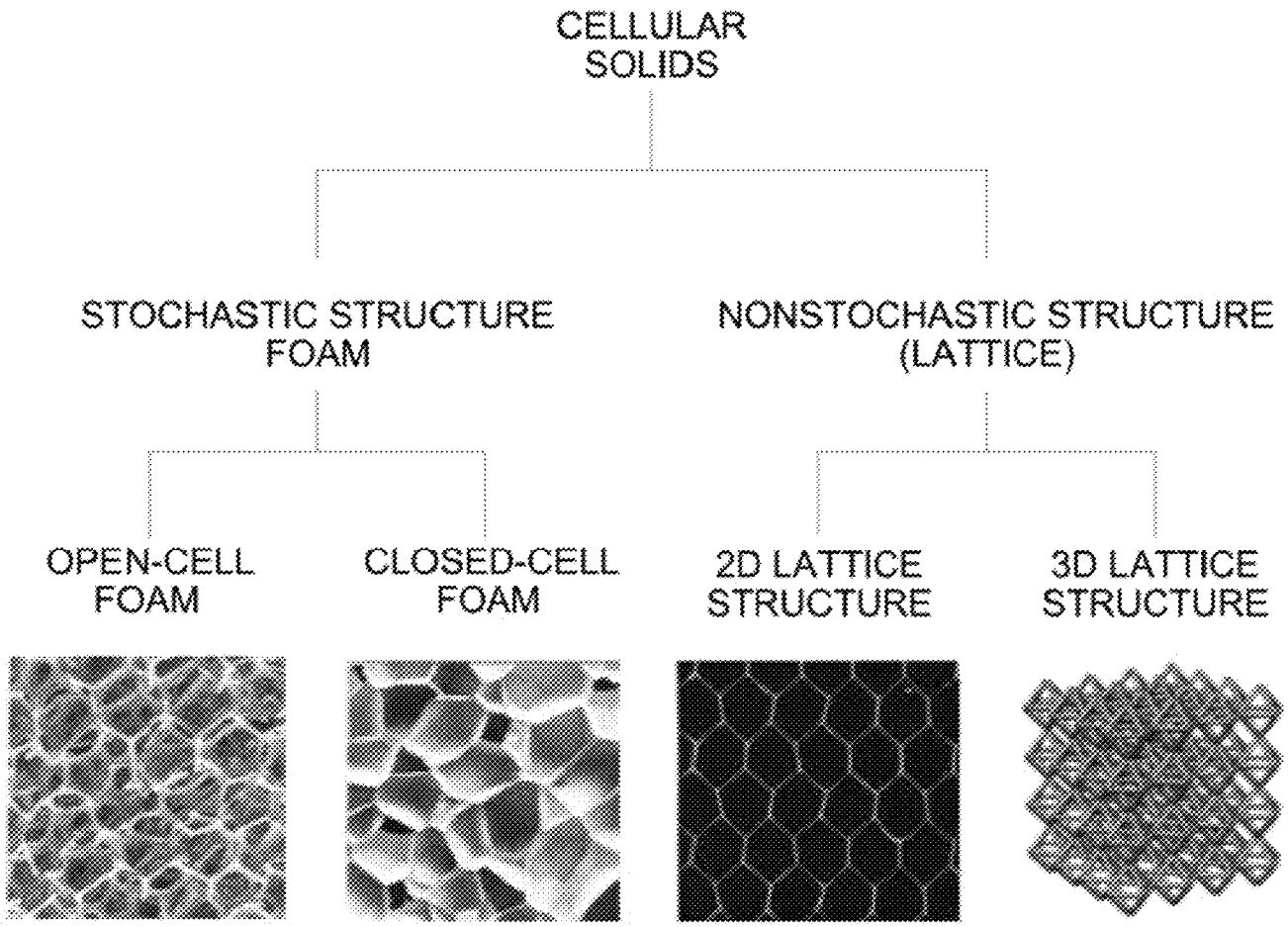
FIG. 18 is a view of the cellular structures.

FIG. 17 shows a device, according to a further aspect of the invention, generally designated by the reference numeral 501, including a casing 502 and a movable insert 504 functionally associated with the damping means.

The damping means includes several layers 533 formed by cellular solids having a stochastic structure (foam).

The layers 533 are arranged in series and can be customized according to the desired mechanical response.

In practice it has been found that the invention achieves the intended aim and objects, providing a recoil damping device for portable firearms that overcomes the current limitations imposed by traditional manufacturing processes, i.e., machining and/or injection molding.

The present invention in particular overcomes the limitations observed in the provision of a device described in patent EP2711660.

In that system, in fact, the maximum stroke of the movable insert is influenced by the thickness of the internal fins of the fixed insert and of the movable insert; since those fins are formed by an injection molding process, it is not possible to reduce their thickness beyond specific values: as a result, the maximum stroke of the comfort system is limited by the current production process.

Advantageously, the present invention provides for the use of one or more bodies formed by cellular solids having stochastic structures (foam) or nonstochastic structures (reticular, lattice) made of various materials (TPU, PA, additive manufacturing materials, etc.) and combined with each other in series and/or in parallel.

The damping device according to the present invention allows to reduce the weight of components, an aspect which is of paramount importance for inertia-driven guns.

An additional advantage of the present invention is that the absorption of recoil energy is maximized by virtue of the complex structures, e.g., auxetic structures with negative Poisson's ratio, and/or biomimesis, whose principle of operation is based on diffuse microdeformations, with possible addition of braking devices also provided by virtue of additive structures.

The damping device according to the present invention also allows to maximize the stability of the firearm, preventing localized deformations that could become fulcrums of rotation of the firearm during firing.

The damping device according to the present invention also minimizes the peak of the recoil force and to maximize its the time delay by virtue of the greater stroke of the movable insert.

The damping device according to the present invention also reduces the number of components to be assembled, by exploiting the potential of additive manufacturing.

This application claims the priority of Italian Patent Application No. 102022000003200 filed on Feb. 21, 2022, the subject matter of which is incorporated herein by reference.

The invention claimed is:

1. A recoil damping device for portable firearms, comprising a casing and a damping means inserted in said casing; said device comprising a movable insert functionally associated with said damping means; said movable insert being adapted to slide along a direction that is substantially axial with respect to said casing; said damping means being constituted by a body formed by a cellular solid;

further comprising a primary braking assembly, mounted in said movable insert, and a secondary braking assembly, integral with said casing; said primary braking assembly dissipating energy by sliding, with friction, with respect to said secondary braking assembly.

2. The device, according to claim 1, wherein the cellular solid has a stochastic structure that comprises layers of material; said layers operate in series.

3. The device, according to claim 1, wherein the cellular solid has a nonstochastic structure that comprises materials chosen among polymeric materials, mutually combined in series and/or in parallel.

4. The device, according to claim 1, wherein said damping means has a side opposite to a buttstock associated with said device; said opposite side comprising a layer made of denser material and having a function of reducing the impact between said casing and said movable insert, when said insert reaches the end of the stroke of the insert.

5. The device, according to claim 1, wherein said movable insert is configured to be coupled to said damping means; wherein the dampening means moves in a direction transverse to the sliding direction of said movable insert to facilitate coupling of the dampening means to the insert.

6. The device, according to claim 1, wherein said movable insert is formed monolithically with said damping means, forming a monolithic body.

7. The device, according to claim 1, wherein said damping means comprises a structure formed by two distinct and concatenated geometries which work in parallel.

8. The device, according to claim 1, wherein said secondary braking assembly comprises two pairs of blades which create friction during the translation of said movable insert.

9. A recoil damping device for portable firearms, comprising a casing and a damping means inserted in said casing; said device comprising a movable insert functionally associated with said damping means; said movable insert being adapted to slide along a direction that is substantially axial with respect to said casing; said damping means being constituted by a body formed by a cellular solid;

wherein said movable insert is configured to be coupled to said damping means; wherein the dampening means moves in a direction transverse to the sliding direction of said movable insert to facilitate coupling of the dampening means to the insert.

10. The device, according to claim 9, wherein the cellular solid has a stochastic structure that comprises layers of material; said layers operate in series.

11. The device, according to claim 9, wherein the cellular solid has a nonstochastic structure that comprises materials chosen among polymeric materials mutually combined in series and/or in parallel.

12. The device, according to claim 9, wherein said damping means has a side opposite to a buttstock associated with said device; said opposite side comprising a layer made of denser material and having a function of reducing the impact between said casing and said movable insert, when said insert reaches the end of the stroke of the insert.

13. The device, according to claim 9, comprising a primary braking assembly, mounted in said movable insert, and a secondary braking assembly, integral with said casing; said primary braking assembly dissipating energy by sliding, with friction, with respect to said secondary braking assembly.

14. The device, according to claim 9, wherein said damping means comprises a structure formed by two distinct and concatenated geometries which work in parallel.

15. The device, according to claim 13, wherein said secondary braking assembly comprises two pairs of blades which create friction during the translation of said movable insert.

* * * * *